US011684839B2

(12) United States Patent
Lee

(10) Patent No.: US 11,684,839 B2
(45) Date of Patent: Jun. 27, 2023

(54) GOLF HIP-TURN TIMING PRACTICE DEVICE

(71) Applicant: Momentia GT, Seoul (KR)

(72) Inventor: Sung Hyuk Lee, Seoul (KR)

(73) Assignee: Momentia GT, Seoul (KR)

( * ) Notice: Subject to any disclaimer, the term of this patent is extended or adjusted under 35 U.S.C. 154(b) by 0 days.

(21) Appl. No.: 17/834,672

(22) Filed: Jun. 7, 2022

(65) Prior Publication Data

US 2022/0401812 A1 Dec. 22, 2022

(51) Int. Cl.
*A63B 69/36* (2006.01)

(52) U.S. Cl.
CPC ..... *A63B 69/3608* (2013.01); *A63B 69/3667* (2013.01)

(58) Field of Classification Search
CPC ..... A63B 69/3608; A63B 69/3667
USPC ..... 473/207, 212, 215, 219, 220, 226, 227, 473/266, 276, 277
See application file for complete search history.

(56) References Cited

U.S. PATENT DOCUMENTS

| | | | | |
|---|---|---|---|---|
| 5,569,095 | A * | 10/1996 | McCollum | A63B 69/3608 446/28 |
| 6,206,787 | B1 * | 3/2001 | Kleppen | A63B 69/0059 473/212 |
| 6,503,148 | B2 * | 1/2003 | Lane | A63B 69/3667 473/215 |
| 8,303,439 | B2 * | 11/2012 | Spallina | A63B 69/0059 473/453 |
| 2003/0220168 | A1 * | 11/2003 | Perry | A63B 69/0059 475/276 |

* cited by examiner

*Primary Examiner* — Nini F Legesse
(74) *Attorney, Agent, or Firm* — Loza & Loza, LLP; Jun S. Ha

(57) ABSTRACT

A golf hip-turn timing practice device according to the present disclosure includes: a fastening belt; a first retainer; a plurality of second retainers; and a hip-turn link stick that is fitted in the first retainer and the second retainers in the longitudinal direction of the fastening belt to be fixed at the position and is longer than the width of shoulders. The golf hip-turn timing practice device provides an advantage in that the golf hip-turn timing practice device enables correct swing timing practice by timing a hip-turn, which is a movement of a lower body, with the movements of the arms and hands of the upper body in golf swing. Further, the golf hip-turn timing practice device provides immediate feedback when the timing is wrong, is easily worn on the waist, and corrects a wrong swing by accurately showing the plane by hip-turn.

8 Claims, 7 Drawing Sheets

GOLF HIP-TURN TIMING PRACTICE DEVICE

PRIORITY CLAIM

This application claims priority from Korean Patent Application No. 20-2021-0001968, filed on Jun. 22, 2021, which is hereby incorporated by reference for all purposes as if fully set forth herein.

TECHNICAL FIELD

The present disclosure relates to a golf hip-turn timing practice device and, more particularly, to a golf hip-turn timing practice device that correctly time a hip-turn, which is an important movement of a lower body in a golf swing, with movement of an upper body for golf swing.

INTRODUCTION

Golf is a sport where improving postures are very important in improving one's game. For example, during a golf swing, a head position and a backbone angle should be maintained until a golf club hits a golf ball, for accurate hitting of the ball. With Golfers generally visit driving ranges to practice their golf swings. However, visiting driving ranges require travel time and costs associated with the driving range. Some golfers even hire golf instructors to practice or to correct their golf swings, which can be even more costly. Therefore, many golfers often look for more convenient and less costly options in practicing their golf swings.

BRIEF SUMMARY OF SOME EXAMPLES

The following presents a summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a form as a prelude to the more detailed description that is presented later.

An objective of the present disclosure is to provide a golf hip-turn timing practice device that enables correct swing timing practice by correctly timing a hip-turn, which is a movement of a lower body, with the movement of the arms and hands of the upper body in golf swing, that provides immediate feedback when the timing is wrong, that is easily worn on the waist, and corrects a wrong swing by accurately showing the plane by hip-turn.

A golf hip-turn timing practice device according to the present disclosure includes: a fastening belt that has a buckle and is configured to be worn on a waist; a first retainer that is positioned at the center of the fastening belt and provides a first fitting passage in the longitudinal direction of the fastening belt; a plurality of second retainers that is disposed at both sides of the first retainer with predetermined gap therebetween on the fastening belt and provides second fitting passages in the longitudinal direction of the fastening belt; and a hip-turn link stick that is fitted in the first retainer and the second retainers in the longitudinal direction of the fastening belt to be fixed at the position and is longer than the width of shoulders, in which the first retainer and the second retainer are elastic fiber sheets, and the second fitting passages of the second retainer are positioned higher than the first fitting passage of the first retainer such that the hip-turn link stick is maintained straight without bending with the fastening belt on a waist.

The golf hip-turn timing practice device further includes an anti-slip pad positioned on the opposite side to the first retainer and the second retainer on the fastening belt, and the anti-slip pad may be a plastic sheet having projections on the surface thereof and may be fixed to the fastening belt by sewing.

The first retainer and the second retainers include: a belt fixing member covering and sewn to the fastening belt; and a fitting member connected to the belt fixing member and forming the first fitting passage and the second fitting passages, and a fitting connection member that connects the belt fixing member and the fitting member forming the second fitting passage may be provided at the second retainer.

An inclination sewing line for forming the second fitting passage may be disposed at the upper portion of the fitting connection member and may be disposed at an angle such that the outer side has a larger diameter than the inner side of the second fitting passage which faces the first fitting passage.

The second retainer may include a first fitting region and a second fitting region that are different in elasticity, and a connection line connecting the first fitting region and the second fitting region.

The hip-turn link stick may have LEDs and acceleration sensors at both ends.

The present disclosure can provide a golf hip-turn timing practice device that enables correct swing timing practice by matching hip-turn, which is a movement of a lower body, with the movement of the arms and hands of the upper body in golf swing, that provides immediate feedback when the timing is wrong, that is easily worn on the waist, and corrects a wrong swing by accurately showing the plane by hip-turn.

These and other aspects of the disclosure will become more fully understood upon a review of the detailed description, which follows. Other aspects, features, and embodiments will become apparent to those of ordinary skill in the art, upon reviewing the following description of specific, exemplary embodiments in conjunction with the accompanying figures. While features may be discussed relative to certain embodiments and figures below, all embodiments can include one or more of the advantageous features discussed herein. In other words, while one or more embodiments may be discussed as having certain advantageous features, one or more of such features may also be used in accordance with the various embodiments discussed herein. In similar fashion, while exemplary embodiments may be discussed below as device, system, or method embodiments it should be understood that such exemplary embodiments can be implemented in various devices, systems, and methods.

DETAILED DESCRIPTION

Figure 1:
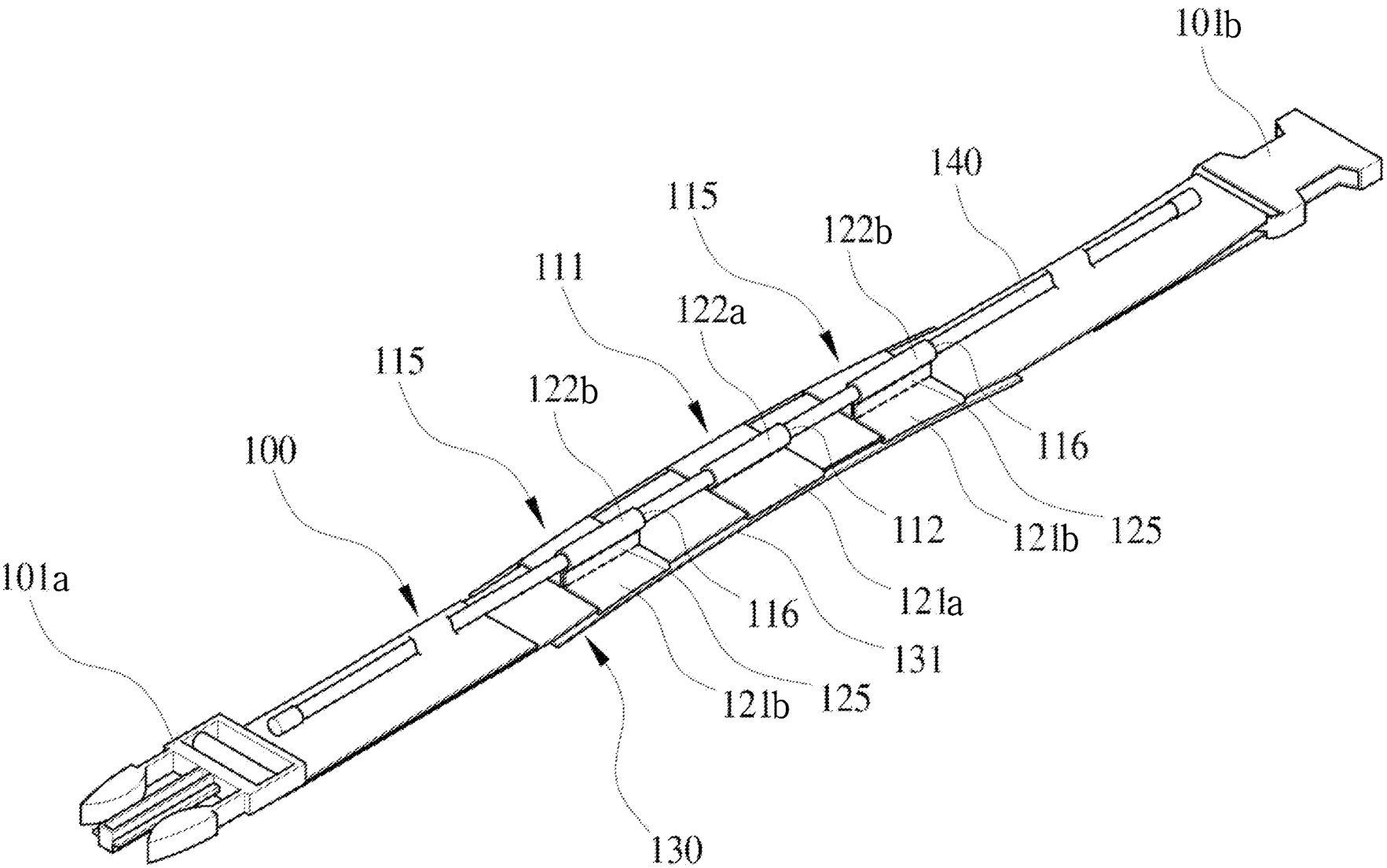
FIG. 1 is an example diagram illustrating a perspective view of a golf hip-turn timing practice device according to an embodiment of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, packaging arrangements.

A swing motion in golf means a series of motions composed of address, take-away, back swing, down swing, impact, release, and finish, and the subject associated with these motions is generally either an upper body or a lower body in a broad sense. Only when movements of these two parts are in harmony with correct timing, a correct swing plane is formed, thus preventing undesirable slicing by accurately hitting a ball. Additionally, the forces generated by the motions of the upper body and the lower body are simultaneously transferred to a ball, and thus the carry can be improved.

However, as for beginner golfers, a consistency in a swing plane is often lacking due to disharmony of timings where a hip-turn that is a movement of the lower body is made too early or too late around the impact period with respect to a movement of the upper body based on hands and arms. Further, beginner golfers usually cannot correctly transfer the power that they can produce to a ball, so they often fail to secure a carry.

Accordingly, beginner golfers require a lot of practice to correctly time movements of the lower body and the upper body. Further, the timing at which a hip-turn should be made is not easy to be corrected when they train by themselves, and thus there is inconvenience that beginner golfers may have to take golf lessons from experts such as a professional golfer to correct a swing, which may be costly. Therefore, there is a need for a training tool that enables a user to train by himself/herself and provides immediate feedback about whether the user is properly training for the timing of hip-turn, which influences a swing plane and power by a golf club.

The positions or disposition of individual components according to embodiments of the present disclosure may be changed and should be understood through a combination of the drawings, similar reference numerals shown in the drawings may indicate the same or similar functions in various respects, a length, an area, a thickness, and detailed shapes may be emphasized for the convenience of description.

A golf hip-turn timing practice device according to one embodiment, which has a high possibility of substantial implementations and high industrial applicability, of various embodiments of the present disclosure is described with reference to common items such as those described above.

Figure 2:
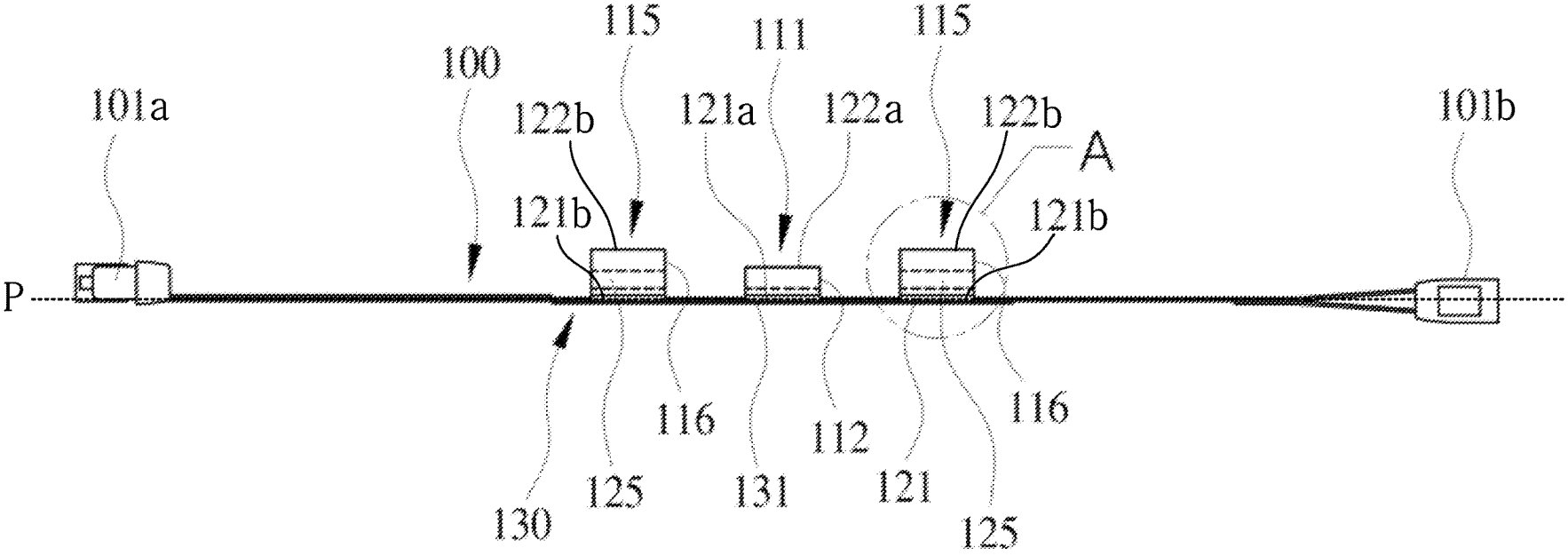
FIG. 2 is an example diagram illustrating a side view of the golf hip-turn timing practice device of FIG. 1.
Figure 3:
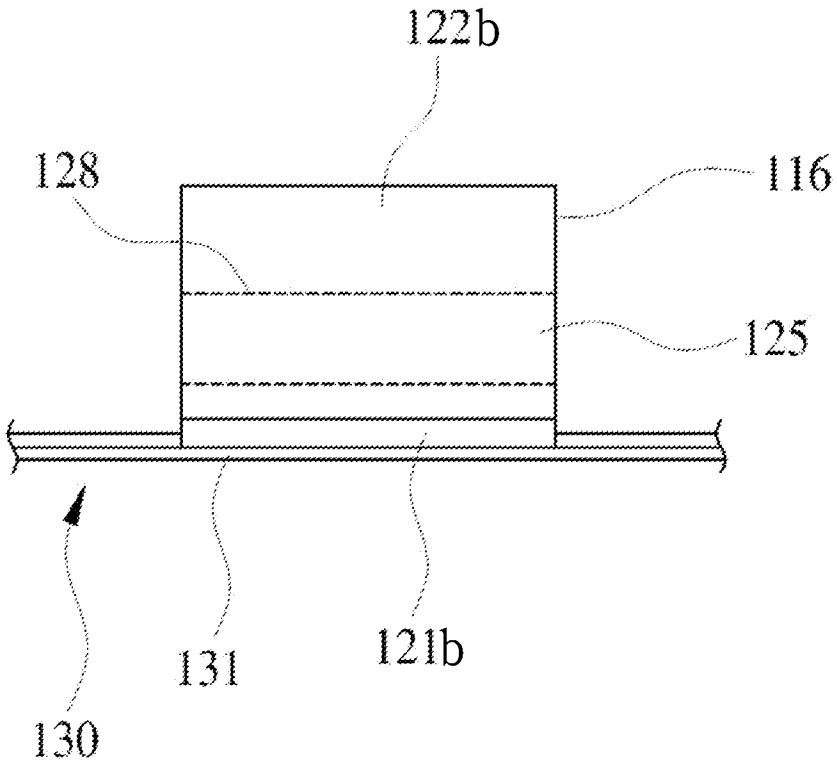
FIG. 3 is an example diagram illustrating an enlarged view of a second retainer disposed in the area A of FIG. 2.
Figure 4:
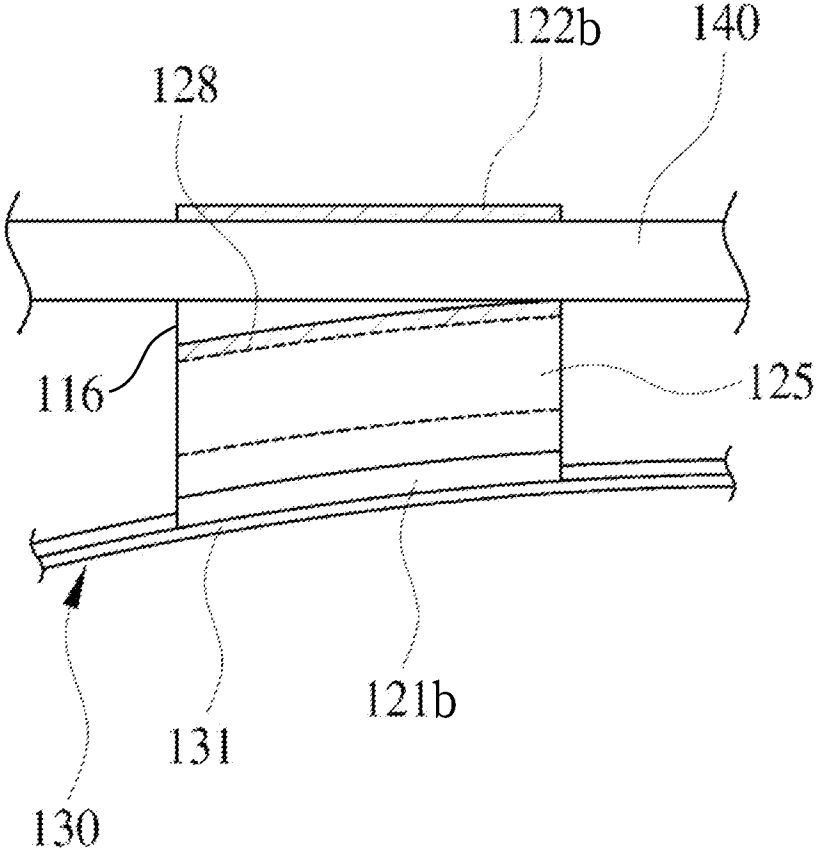
FIG. 4 is an example diagram illustrating a cross-sectional view showing a state when a user wears a hip-turn link stick of FIG. 3.

FIG. 1 is an example diagram illustrating a perspective view of a golf hip-turn timing practice device according to an embodiment of the present disclosure. FIG. 2 is example diagram illustrating a side view of the golf hip-turn timing practice device of FIG. 1. FIG. 3 is an example diagram illustrating an enlarged view of a second retainer disposed in the area A of FIG. 2, according to some aspects, FIG. 4 is an example diagram illustrating a cross-sectional view showing a state when a user wears a hip-turn link stick of FIG. 3, according to some aspects.

Referring to FIGS. 1 to 3, a golf hip-turn timing practice device according to an embodiment of the present disclosure includes a fastening belt 100 that is worn on the waist, a first retainer 111 that is disposed at a center of the fastening belt 100 and provides a first fitting passage 112 in a longitudinal direction of the fastening belt 100, and multiple second retainers 115 that are disposed at both sides of the first retainer 111 with a predetermined gap between each of the second retainers 115 and the first retainer 111 on the fastening belt 100 and provide second fitting passages 116 in the longitudinal direction of the fastening belt 100. The golf hip-turn timing practice device further includes a hip-turn link stick 140 that is fitted through the first retainer 111 and the second retainers 115 in the longitudinal direction of the fastening belt 100 to be fixed at a fixed position. In some aspects, the hip-turn link stick 140 may be fitted through the first fitting passage 112 provided by the first retainer 111 and the second fitting passages 116 provided by the second retainers 115. In some aspects, the hip-turn link stick 140 should be sufficiently long, such that if a user makes a hip-turn too early (e.g., prior to an impact with the golf ball), the hip-turn link stick 140 may protrude to a front of the user enough to interfere with the golf swing of the user. In an aspect, the hip-turn link stick 140 may be longer than a width of shoulders of the user using the golf hip-turn timing practice device.

In some aspects, the fastening belt 100 may have a buckle 101 to fasten the fastening belt 100. The buckle 101 may include a first buckle member 101*a* and a second buckle member 101*b*. The fastening belt 100 may be formed in a belt shape to be worn on the waist of the user. In an example, the first buckle member 101*a* and the second buckle member 101*b* may be snap-fitted, where the buckle 101 may be a clip buckle. The first buckle member 101*a* and the second buckle member 101*b* may be coupled to two respective ends of the fastening belt 100. The buckle 101 may have a snap-fit structure and may be disposed on the fastening belt 100 such that one of the first buckle member 101*a* or the second buckle member 101*b* can be moved with respect to the other one of the first buckle member 101*a* or the second buckle member 101*b*.

In some aspects, the first retainer 111 and the second retainers 115 may be provided to elastically cover/wrap and thereby fix the hip-turn link stick 140 on the fastening belt 100. The first retainer 111 and the second retainers 115 may be aligned in a line with respective gaps between the first retainer 111 and the second retainers 115 in some regions of the fastening belt 100.

In some aspects, the first retainer 111 and the second retainers 115 may be made of an elastic fiber sheet. In some aspects, the second fitting passages 116 of the second retainer 115 may be positioned higher than the first fitting passage 112 of the first retainer 111 with respect to a plane of the fastening belt 100, such that the hip-turn link stick 140 may be kept straight without bending when the fastening belt 100 is bent to be worn on a waist. For example, as shown in FIG. 2, the second fitting passages 116 of the second retainer 115 may be positioned higher than the first fitting passage 112 of the first retainer 111 with respect to a plane P of the fastening belt 100 when the fastening belt 100 is laid flat.

The fastening belt 100 may be bent in an annular shape that is curved corresponding to the user's waist when the fastening belt 100 is worn on the waist. The hip-turn link stick 140 can provide means to accurately control a golf swing motion of the user by turning with a hip-turn at a swing motion timing of the user when the hip-turn link stick 140 is positioned horizontally in front of the user.

The second retainers 115 at both sides of the first retainer 111 may be positioned further behind the user than the first retainer 111 to correspond to the shape of the user's waist when the fastening belt 100 is worn on the waist and thus is arched. However, since the second fitting passages 116 of the second retainers 115 are positioned higher than the first fitting passage 112 of the first retainer 111 on the fastening belt 100 with respect to the plane P of the fastening belt 100, the positions of the second fitting passages 116 are corrected with respect to the first fitting passage 112 such that the hip-turn link stick 140 is kept horizontal.

Referring to FIGS. 1 to 4, the positions of the second fitting passages 116 of the second retainers 115 may be sufficiently adjusted with respect to the first fitting passage 112 by the detailed structures, elasticity, and sewing structures of the first retainer 111 and the second retainers 115 as described below.

The first retainer 111 may include a first belt fixing member 121*a* and the second retainers 115 include respective second belt fixing members 121*b*, the first and second belt fixing members 121*a*, 121*b* covering and being attached to the fastening belt 100. A first fitting member 122*a* may be connected to the first belt fixing member 121*a* and forming the first fitting passage 112, and second fitting members 122*b* may be respectively connected to the second belt fixing members 121*b* and forming the second fitting passages 116.

In some aspects, the first retainer 111 and the second retainers 115 may be woven using elastic fibers to have elasticity or may include a material formed by mixing synthetic fibers and elastic fibers or may include rubber materials such as rubber bands.

In some aspects, each of the first and second belt fixing member 121*a*, 121*b* may be attached or sewn to the fastening belt 100 to cover/wrap the fastening belt 100, and thus is firmly fixed to the fastening belt 100 and any damages due to frictions from the hip-turn link stick 140 being fitted through the first fitting passage 112 and the second fitting passages 116 may be sufficiently prevented.

In some aspects, each of the first and second fitting members 122*a*, 122*b* may be attached or sewn at the center of the belt fixing member 121, thereby providing the first fitting passage 112 and the second fitting passages 116. Openings of the first and second fitting members 122*a*, 122*b* may be elastically and circularly opened so that the hip-turn link stick 140 can be fitted through the openings of the first and second fitting members 122*a*, 122*b*.

In some aspects, the first and second fitting members 122*a*, 122*b* covers/wraps may wrap around the hip-turn link stick 140 when the hip-turn link stick 140 is fitted, and may secure the hip-turn link stick 140 in a fixed position by applying contact friction on the outer surface of the hip-turn link stick 140 with the elasticity of the first and second fitting members 122*a*, 122*b*.

A fitting connection member 125 that connects the second belt fixing member 121*b* and the second fitting member 122*b* forming the second fitting passage 116 may be provided at the second retainer 115.

In some aspects, the fitting connection member 125 of each of the second retainers 115 may be stretched by elastic force of the hip-turn link stick 140 having elasticity that maintains a horizontal shape when the fastening belt 100 is worn, thereby preventing the hip-turn link stick 140 from extending backward at both sides of a user.

In some aspects, as shown in FIGS. 3 and 4, an inclination sewing line 128 for forming the second fitting passage 116 may be disposed at the upper portion of the fitting connection member 125. The inclination sewing line 128 may be disposed at an angle such that the outer side has a larger diameter than the inner side of the second fitting passage 116 which faces the first fitting passage 112.

Since the outer side of the second fitting passage 116 of the second retainer 115 is larger than the inner side close to the first fitting passage 112, it is more easily stretched by force applied by the hip-turn link stick 140 when the golf hip-turn timing practice device is worn using the fastening belt 100. Accordingly, the hip-turn link stick 140 is fitted in the second fitting passage 116 and maintained in a horizontal position at both sides of the first fitting passage 112. The stretching of the second fitting passage 116 due to the force applied by the hip-turn link stick 140 and the fastening belt 100 being arched when worn by a user is illustrated in FIG. 4, for example.

Referring to FIGS. 1 to 4, in some aspects, the present embodiment may further include an anti-slip pad 130 disposed on the opposite side to the first retainer 111 and the second retainers 115 on the fastening belt 100.

In some aspects, the anti-slip pad 130 may include a plastic sheet having projections on the surface and sewn to the fastening belt 100 and may prevent the fastening belt 100 from moving up, down, left, and right on a user's body.

In some aspects, The anti-slip pad 130 may be a plastic sheet that can easily bend to correspond to the user's waist and the projections on the surface may provide a friction surface 131 like sandpaper.

Figure 5A:
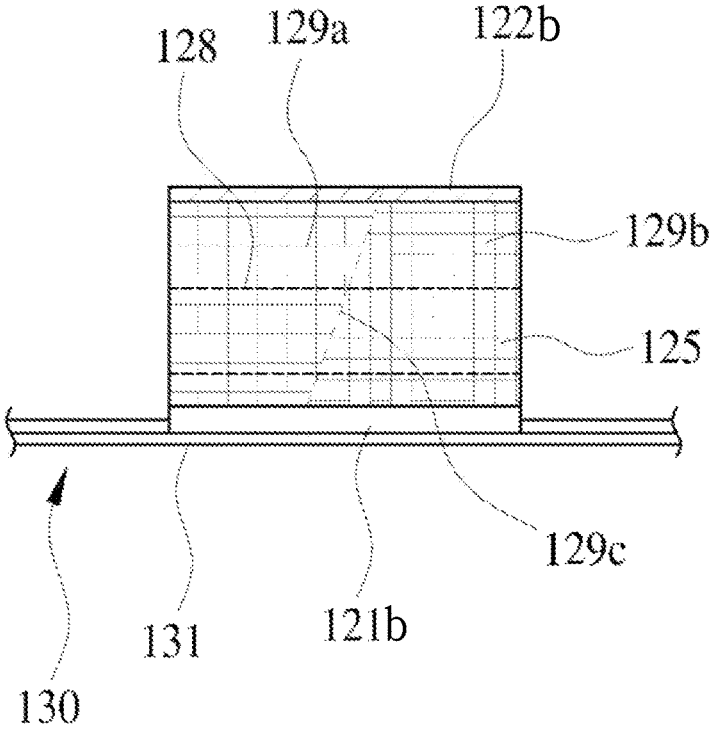
FIG. 5 is an example diagram illustrating a detailed view showing different elastic structures of a second retainer according to another embodiment.
Figure 5B:
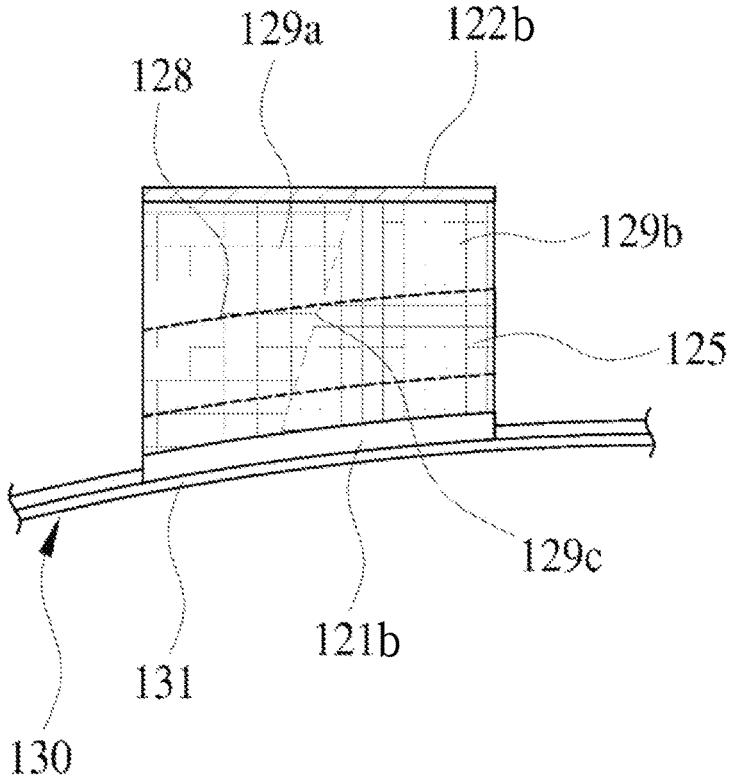

FIGS. 5A and 5B are example diagrams illustrating detailed views showing different elastic structures of a second retainer according to another embodiment.

Referring to FIGS. 5A and 5B, a second retainer 115 according to another embodiment may include a first fitting region 129*a* and a second fitting region 129*b* of which the densities of fiber tissue are different, and a connection line 129*c* connecting the first fitting region 129*a* and the second fitting region 129*b* at an angle.

In some aspects, the first fitting region 129*a* may include a fiber tissue that is easily stretched more than the second fitting region 129*b* by horizontal support by the hip-turn link stick 140. That is, the first fitting region 129*a* is lower in density of fibers or wove thinner than the second fitting region 129*b*. The stretching of the first fitting region 129*a* (e.g., due to the force applied by the hip-turn link stick 140 and the fastening belt 100 being arched) with little stretching of the second fitting region 129*b* when worn by a user is illustrated in FIG. 5B, for example.

Figure 6:
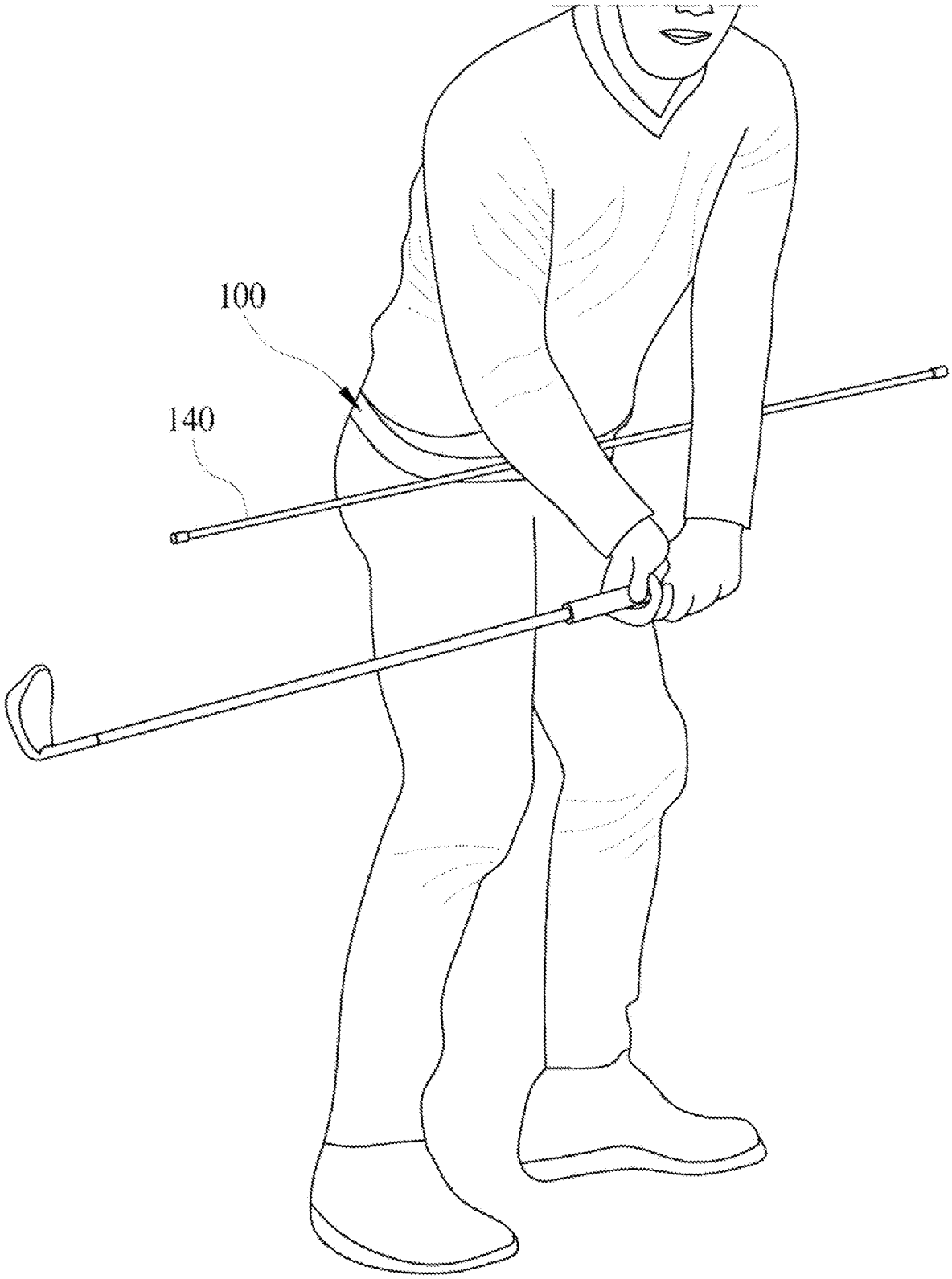
FIGS. 6 and 7 are example diagrams illustrating the state when the golf hip-turn timing practice device according to an embodiment of the present disclosure is used for swing motion.
Figure 7:
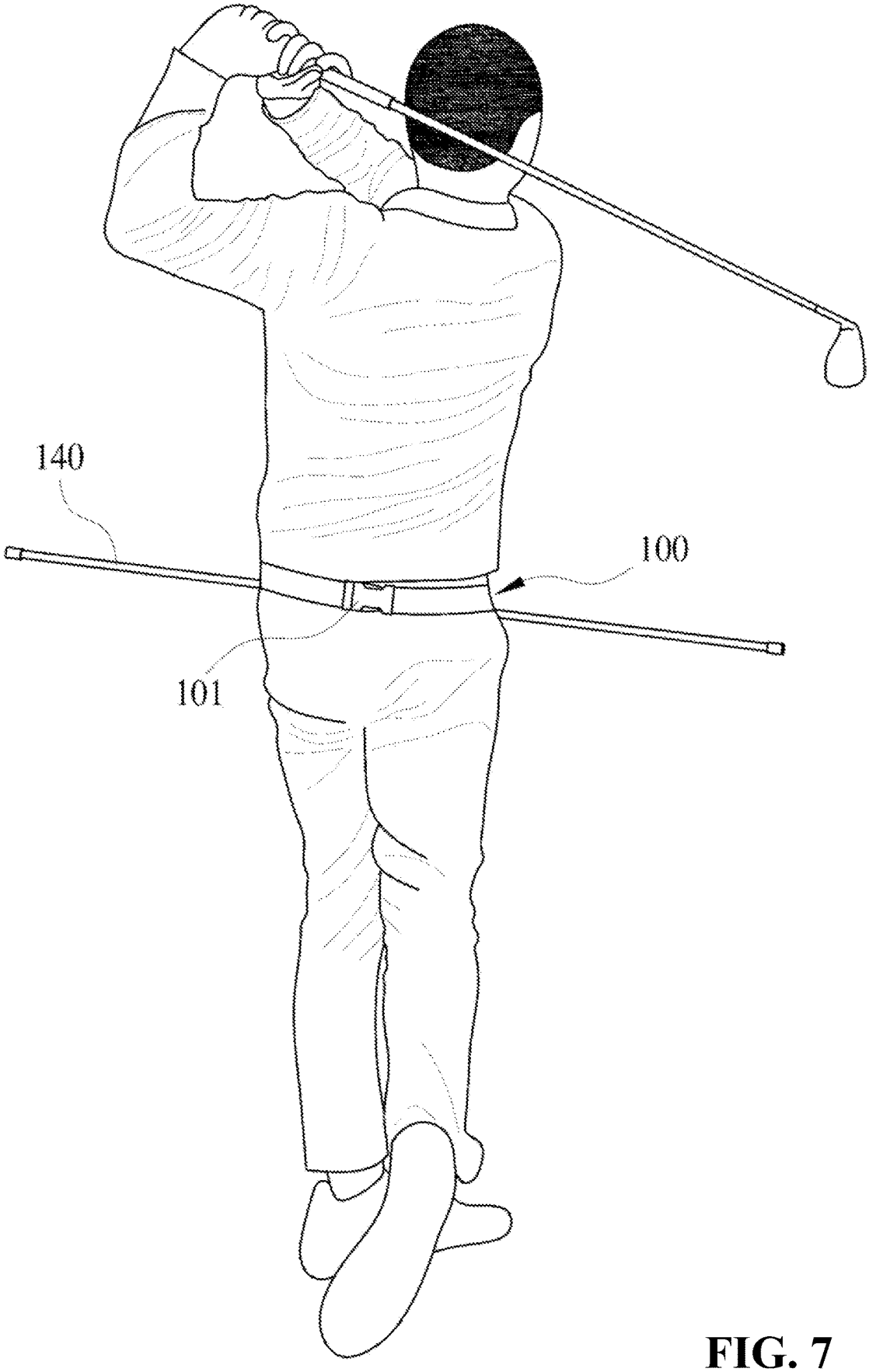

FIGS. 6 and 7 are example diagrams illustrating a state when the golf hip-turn timing practice device according to an embodiment of the present disclosure is used for a swing motion.

The power of a golf swing is sufficiently increased only when movement of a lower body, such as a hip-turn, and movement of an upper body, such as movement of arms, are correctly timed in the impact period. If hips are turned early before reaching the impact with the golf ball, the power of the lower body may be lost before the impact, which may cause the golf ball being hit only by the power of the arms and thereby may reduce the golf swing power for hitting the golf ball.

Further, when a hip-turn is made too early without being correctly timed with the movement of the upper body, the upper body may be affected and rotated by the turn of the lower body. In this case, the left shoulder may undesirably protrude forward in a down swing and the golf ball may be hit while the swing plane naturally changes inside from the outside, which causes slicing to occur.

FIG. 6 shows a user in down swing of the golf club while wearing the golf hip-turn timing practice device having the fastening belt 100 worn around the user's waist, with the. FIG. 7 shows the user after finishing the swing of the golf club while wearing the golf hip-turn timing practice device having the fastening belt 100 worn around the user's waist. Referring to FIGS. 6 and 7, in order to prevent an undesirable swing motion, a swing motion should be made such that a hip-turn is maximally suppressed in down swing. When the user wears the golf hip-turn timing practice device, to prevent an undesirable swing motion, the arms holding a golf club should be moved down during the down swing without hitting the hip-turn link stick 140 horizontally attached to the waist, and hip-turn should be made at the timing when the golf club head hits the ball.

If the swing includes an undesirable motion and/or a hip-turn is made early, the right side of the hip-turn link stick 140 may rotate (e.g., about 45 degrees from the initial position before the swing) and may protrude forward in front of the user, thereby blocking the swing plane of the golf club that is being swung down toward the golf ball. As such, the golf club may come in contact with the hip-turn link stick 140, allowing the user to recognize that the hip-turn has been made at a wrong timing.

If the user recognizes a wrong swing motion based on the contact between the hip-turn link stick 140 and the golf club, the user practice the golf swing sufficiently while keeping the swing of the arms and the timing of hip-turn in mind in order to avoid hitting the hip-turn link stick 140 with the golf club in a down swing. Accordingly, the user may train for a desirable hip-turn timing according to a swing motion for increasing the power for increasing the carry, such that the user may learn to time a hip-turn of the lower body and movement of the arms of the upper body in the impact period.

According to the present embodiment, it is possible to keep the swing plane of the upper body in the in-out-in plane and accurately send a golf ball to a desired target direction by wearing the fastening belt 100 of the golf hip-turn timing practice device with the horizontal hip-turn link stick 140 and correcting the hip-turn timing of the lower body. Hence, the user may practice the user's golf swing by wearing the golf hip-turn timing practice device, without having to hire a golf instructor and/or having to go to a driving range.

Although preferred embodiments of the present disclosure are described above with reference to the accompanying drawings, those skilled in the art would understand that the present disclosure may be implemented in various ways without changing the necessary features or the spirit of the prevent disclosure. Therefore, the embodiments described above are only examples and should not be construed as being limitative in all respects.

What is claimed is:

1. A golf hip-turn timing practice device, comprising:

a fastening belt including a buckle and configured to be worn on a waist of a user;

a first retainer positioned at a center of the fastening belt and including a first fitting passage in a longitudinal direction of the fastening belt;

a plurality of second retainers disposed at both sides of the first retainer with a predetermined gap between the first retainer and each of the plurality of second retainers on the fastening belt, the plurality of second retainers respectively including second fitting passages in the longitudinal direction of the fastening belt; and a hip-turn link stick fitted in the first retainer and the second retainers in the longitudinal direction of the fastening belt to be secured at a fixed position and is longer than a width of shoulders of the user, wherein the first retainer and the plurality of second retainers are made of elastic fiber sheets, and the second fitting passages of the plurality of second retainers are positioned higher than the first fitting passage of the first retainer such that the hip-turn link stick is maintained straight without bending with the fastening belt worn on the waist of the user, wherein the golf hip-turn timing practice device further includes an anti-slip pad positioned on an opposite side to the first retainer and the plurality of second retainers on the fastening belt, and wherein the anti-slip pad includes a plastic sheet having projections on a surface thereof and is fixed to the fastening belt by sewing.

2. The golf hip-turn timing practice device of claim 1, wherein the first retainer includes:

a first belt fixing member covering and sewn to the fastening belt; and a first fitting member connected to the first belt fixing member and forming the first fitting passage.

3. The golf hip-turn timing practice device of claim 2, wherein each of the plurality of second retainers includes:

a second belt fixing member covering and sewn to the fastening belt; and a second fitting member connected to the second belt fixing member and forming the second fitting passage, and a fitting connection member that connects the second belt fixing member and the second fitting member forming the second fitting passage is provided at the second retainer.

4. The golf hip-turn timing practice device of claim 3, wherein an inclination sewing line for forming the second fitting passage is disposed at an upper portion of the fitting connection member and is disposed at an angle such that an outer side has a larger diameter than an inner side of the second fitting passage which faces the first fitting passage.

5. The golf hip-turn timing practice device of claim 3, wherein each of the plurality of second retainers includes a first fitting region and a second fitting region that are different in elasticity, and a connection line connecting the first fitting region and the second fitting region.

6. A golf hip-turn timing practice device, comprising:

a fastening belt configured to be worn on a waist of a user;

a first retainer positioned at a center of the fastening belt and including a first fitting passage in a longitudinal direction of the fastening belt;

a plurality of second retainers disposed at both sides of the first retainer with a predetermined gap between the first retainer and each of the plurality of second retainers on the fastening belt, the plurality of second retainers respectively including second fitting passages in the longitudinal direction of the fastening belt; and a hip-turn link stick fitted in the first retainer and the second retainers in the longitudinal direction of the fastening belt to be secured at a fixed position, the hip-turn link stick being positioned horizontally when the user is standing straight without a hip-turn, wherein when the user turns the user's hip, the hip-turn link stick rotates with the user's hip turning to protrude to a front of the user.

7. The golf hip-turn timing practice device of claim 6, wherein the hip-turn link stick is longer than a width of shoulders of the user.

8. The golf hip-turn timing practice device of claim 6, wherein the second fitting passages of the plurality of second retainers are positioned higher than the first fitting passage of the first retainer such that the hip-turn link stick is maintained straight without bending with the fastening belt worn on the waist of the user.

* * * * *